US005632690A

United States Patent [19]

McConville

[11] Patent Number: 5,632,690

[45] Date of Patent: May 27, 1997

[54] GOLF CLUB SHAFT PROTECTIVE WRAP

[76] Inventor: Dennis McConville, 336 Kelly Ave., Brick, N.J. 08724

[21] Appl. No.: 522,073

[22] Filed: Aug. 31, 1995

[51] Int. Cl.[6] ..... A63B 55/00

[52] U.S. Cl. ..... 473/282; 473/131; 206/315.6

[58] Field of Search ..... 473/282, 131; 206/315.2, 315.4, 315.6; 128/894

[56] References Cited

U.S. PATENT DOCUMENTS

| | | | |
|---|---|---|---|
| 4,045,034 | 8/1977 | Thomas | 473/282 |
| 4,174,747 | 11/1979 | Boles | 206/315.6 |
| 4,414,964 | 11/1983 | Farino et al. | 128/894 |
| 4,898,222 | 2/1990 | Gaffney | 206/315.4 |
| 4,938,349 | 7/1990 | Burns | 206/315.6 |
| 5,088,600 | 2/1992 | Kopp, Jr. | 206/315.2 |
| 5,284,194 | 2/1994 | Gaffney | 206/315.2 |
| 5,393,581 | 2/1995 | Mares | 473/282 |
| 5,505,300 | 4/1996 | Joh | 206/315.6 |

*Primary Examiner*—Mark S. Graham

[57] ABSTRACT

A wrap for protecting a portion of a golf club shaft from abrasion within a golf bag. The inventive device includes a pad strip for circumferentially extending about a shaft of a golf club. A securing strip extends from the pad strip for securing the pad strip in an annular configuration about the shaft to protect the shaft from abrasion against an upper interior surface of a receiving tube of a golf bag.

2 Claims, 3 Drawing Sheets

GOLF CLUB SHAFT PROTECTIVE WRAP

BACKGROUND OF THE INVENTION

1. Field of the Invention

The present invention relates to golfing devices and more particularly pertains to a golf club shaft protective wrap for protecting a portion of a golf club shaft from abrasion within a golf bag.

2. Description of the Prior Art

The use of golfing devices is known in the prior art. More specifically, golfing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art golfing devices include U.S. Pat. No. 4,938,349; U.S. Pat. No. 5,000,238; U.S. Pat. No. 5,005,624; U.S. Pat. No. 5,050,884; U.S. Pat. No. 5,088,600; U.S. Pat. No. 5,275,278; U.S. Pat. No. 5,284,194; and U.S. Pat. No. 5,311,987.

While these devices fulfill their respective, particular objectives and requirements, the aforementioned patents do not disclose a golf club shaft protective wrap for protecting a portion of a golf club shaft from abrasion within a golf bag which includes a pad strip for circumferentially extending about a shaft of a golf club, and a securing strip extending from the pad strip for securing the pad strip in an annular configuration about the shaft to protect the shaft from abrasion against an upper interior surface of a receiving tube of a golf bag.

In these respects, the golf club shaft protective wrap according to the present invention substantially departs from the conventional concepts and designs of the prior art, and in so doing provides an apparatus primarily developed for the purpose of protecting a golf club shaft from abrasion within a golf bag.

SUMMARY OF THE INVENTION

In view of the foregoing disadvantages inherent in the known types of golfing devices now present in the prior art, the present invention provides a new golf club shaft protective wrap construction wherein the same can be utilized for protecting a portion of a golf club shaft from abrasion within a golf bag. As such, the general purpose of the present invention, which will be described subsequently in greater detail, is to provide a new golf club shaft protective wrap apparatus and method which has many of the advantages of the golfing devices mentioned heretofore and many novel features that result in a golf club shaft protective wrap which is not anticipated, rendered obvious, suggested, or even implied by any of the prior art golfing devices, either alone or in any combination thereof.

To attain this, the present invention generally comprises a wrap for protecting a portion of a golf club shaft from abrasion within a golf bag. The inventive device includes a pad strip for circumferentially extending about a shaft of a golf club. A securing strip extends from the pad strip for securing the pad strip in an annular configuration about the shaft to protect the shaft from abrasion against an upper interior surface of a receiving tube of a golf bag.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf club shaft protective wrap apparatus and method which has many of the advantages of the golfing devices mentioned heretofore and many novel features that result in a golf club-shaft protective wrap which is not anticipated, rendered obvious, suggested, or even implied by any of the prior art golfing devices, either alone or in any combination thereof.

It is another object of the present invention to provide a new golf club shaft protective wrap which may be easily and efficiently manufactured and marketed.

It is a further object of the present invention to provide a new golf club shaft protective wrap which is of a durable and reliable construction.

An even further object of the present invention is to provide a new golf club shaft protective wrap which is susceptible of a low cost of manufacture with regard to both materials and labor, and which accordingly is then susceptible of low prices of sale to the consuming public, thereby making such golf club shaft protective wraps economically available to the buying public.

Still yet another object of the present invention is to provide a new golf club shaft protective wrap which provides in the apparatuses and methods of the prior art some of the advantages thereof, while simultaneously overcoming some of the disadvantages normally associated therewith.

Still another object of the present invention is to provide a new golf club shaft protective wrap for protecting a portion of a golf club shaft from abrasion within a golf bag.

Yet another object of the present invention is to provide a new golf club shaft protective wrap which includes a pad strip for circumferentially extending about a shaft of a golf club, and a securing strip extending from the pad strip for securing the pad strip in an annular configuration about the shaft to protect the shaft from abrasion against an upper interior surface of a receiving tube of a golf bag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
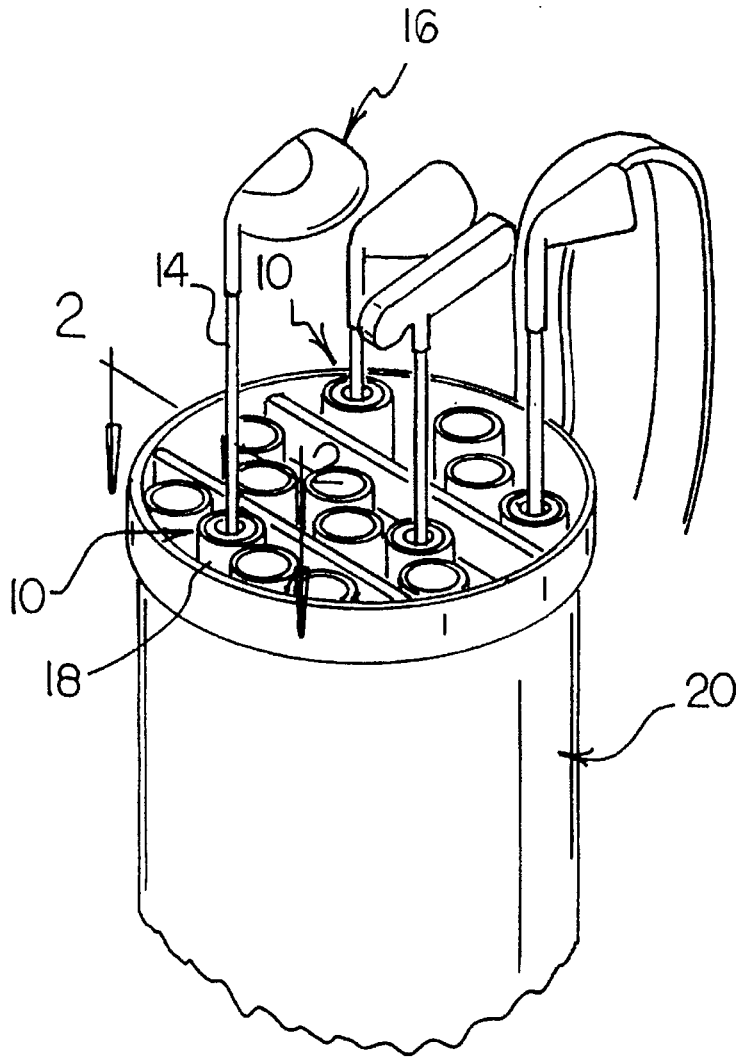
FIG. 1 is an isometric illustration of a plurality of golf club shaft protective wraps according to the present invention in use.

With reference now to the drawings, and in particular to FIGS. 1–6 thereof, a new golf club shaft protective wrap embodying the principles and concepts of the present invention and generally designated by the reference numeral 10 will be described.

Figure 2:
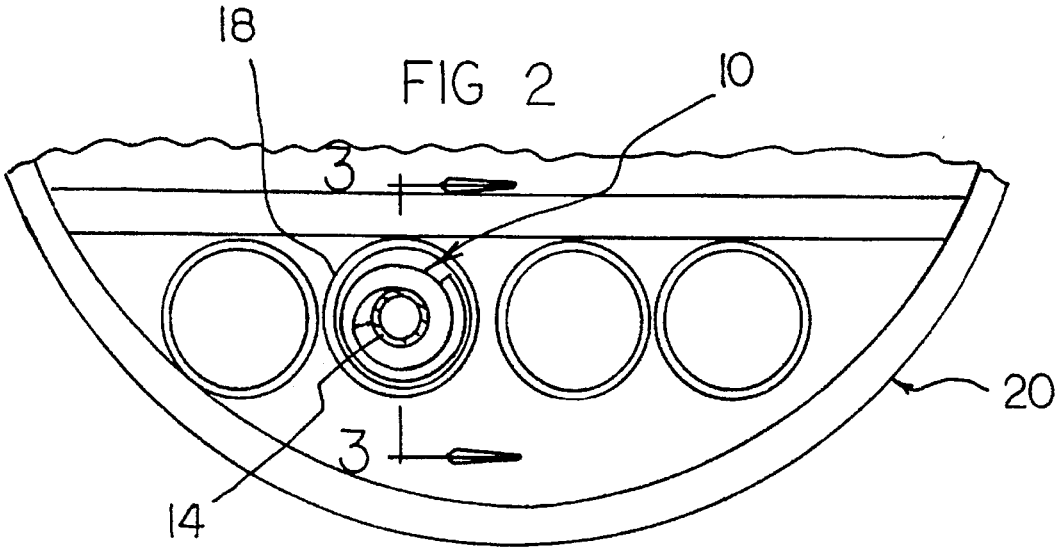
FIG. 2 is a top plan view of a single golf club shaft protective wrap in use taken from line 2—2 of FIG. 1.
Figure 3:
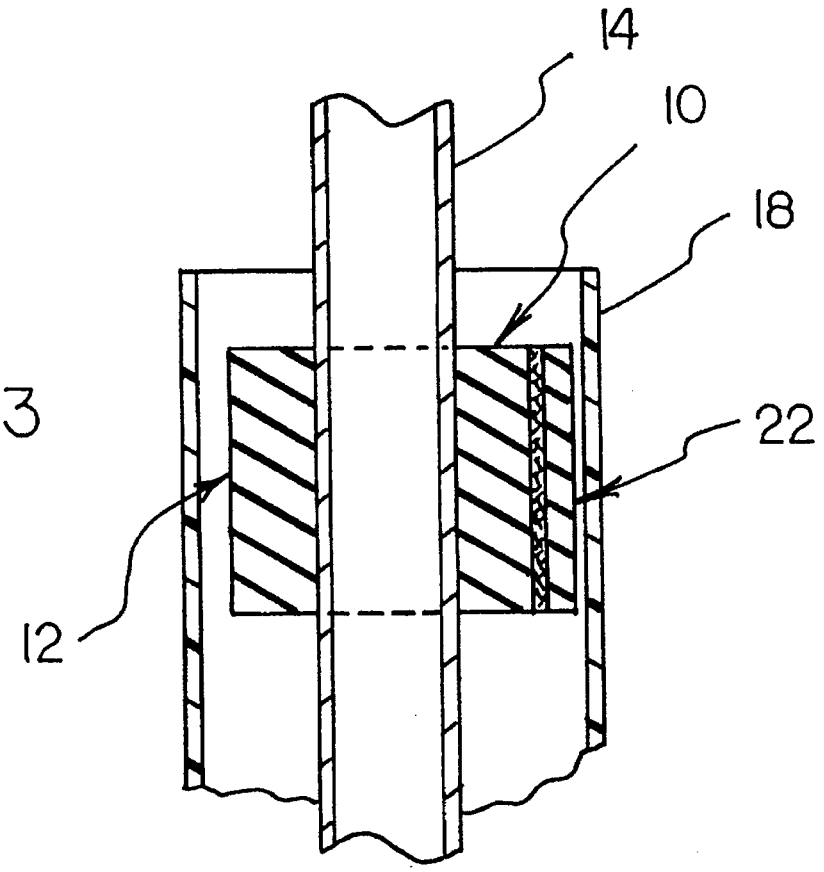
FIG. 3 is a cross sectional view taken along line 3—3 of FIG. 2.

More specifically, it will be noted that the golf club shaft protective wrap 10 comprises a pad means 12 (see FIG. 4) positionable circumferentially about a shaft 14 of a golf club 16 substantially as shown in FIGS. 1 through 3 of the drawings and for positioning between an exterior surface of the shaft 14 and an interior surface of a receiving tube 18 of a golf bag 20 so as to protect the shaft 14 from abrasion against an upper interior surface of the receiving tube 18. A securing means 22 extends from the pad means 12 for securing the pad means in an annular configuration about the shaft 14 of the golf club 16. By this structure, the present invention 10 can be circumferentially positioned about the shaft 14 of a golf club 16 and subsequently inserted into a receiving tube 18 of the golf bag 20 so as to protect the shaft 14 during carrying or movement of the golf bag 20.

Figure 4:
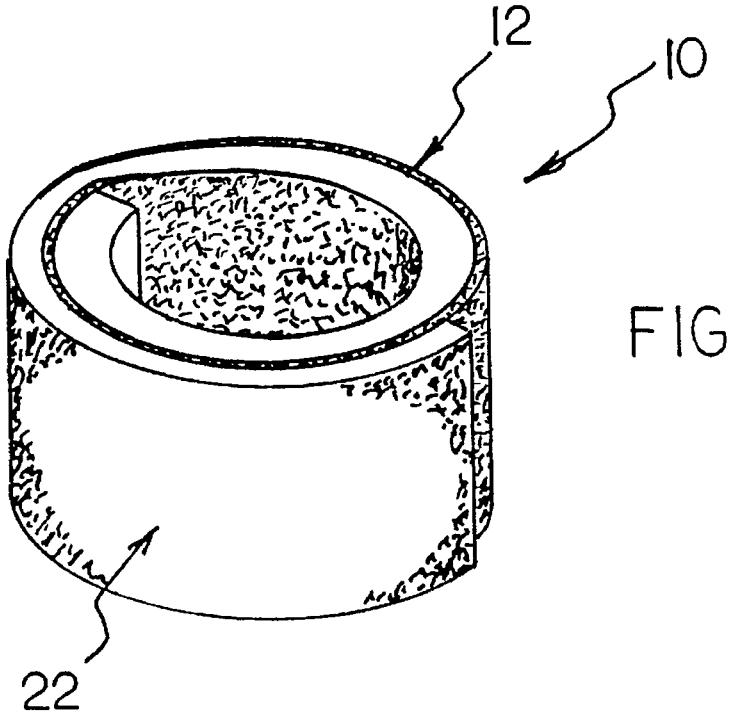
FIG. 4 is an isometric illustration of the invention, per se, in an annular configuration.
Figure 5:
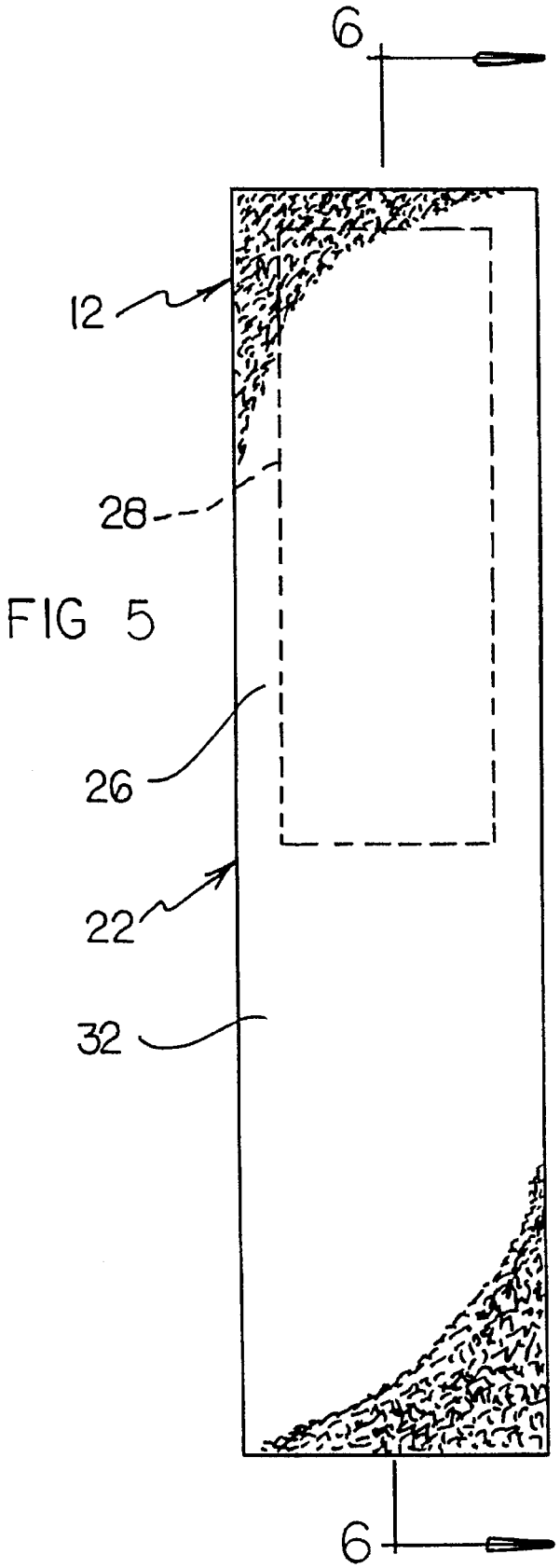
FIG. 5 is an elevation view of the invention in an unrolled configuration.
Figure 6:
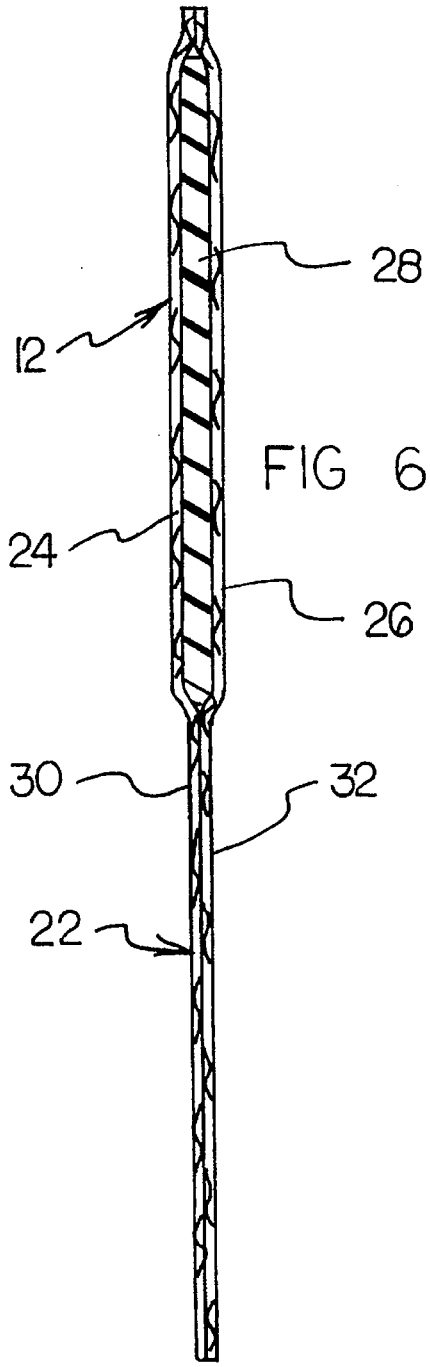
FIG. 6 is a cross sectional view taken along line 6—6 of FIG. 5.

Referring to FIGS. 4 through 6 wherein the present invention 10 is illustrated in detail, it can be shown that the pad means 12 of the present invention 10 preferably comprises a first pad strip 24 coupled to a second pad strip 26 and including an elongated pad member 28 interposed between the pad strips 24 and 26. The pad strips 24 and 26 can be stitched or adhesively coupled to opposed sides of the elongated pad member 28 so as to form the pad means 12. By this structure, the elongated pad member 28 and the pad strips 24 and 26 attached thereto can be circumferentially extended about the shaft 14 of a golf club 16 so as to reside in an annular configuration thereabout for positioning between the shaft 14 and the receiving tube 18 as shown in FIG. 2 of the drawings.

With continuing reference to FIGS. 4 through 6, it can be shown that the securing means 22 of the present invention 10 preferably comprises a first securing strip 30 extending from the pad means 12, and a second securing strip 32 stitched or adhesively coupled to the first securing strip 30. The securing means 22 is operable to be extended or folded onto a portion of the pad means 12 when the device 10 is positioned in an annular configuration as shown in FIG. 4 of the drawings. The securing means 22 subsequently attaches to the pad means 12 so as to retain such annular configuration of the device 10. To this end, at least one of the pad strips 24 or 26 is formed of a hook and loop fabric fastening material such as is commonly known under the trademarked name "VELCRO", with one of the securing strips 30 or 32 being similarly comprised or having attached thereto hook and loop fabric fastening material cooperable with the hook and loop fabric fastening material of one or both of the pad strips 24 or 26. By this structure, one of the securing strips 30 or 32 can be positioned into abutting contact with one of the pad strips 24 and 26 such that cooperable hook and loop fabric fastening materials thereof will be engaged to retain the device 10 in an annular configuration about a shaft 14 of a golf club 16 within a receiving tube 18 of a golf bag 20.

Preferably, the pad strips 24 and 26 and the securing strips 30 and 32 are all formed of a hook and loop fabric fastening material. Also, it is desirable in the construction of the present invention for the first pad strip 24 to be integrally coupled to the first securing strip 30, with the second pad strip 26 being an integral portion of the second securing strip 32. By this structure, the present invention 10 can be easily constructed by simply coupling the pad strips 24 and 26 together with the elongated pad member 28 therebetween, and further coupling the securing strips 30 and 32 together through a single stitching or adhesive securing operation.

In use, the golf club shaft protective wrap 10 of the present invention can be easily utilized for protecting a portion of a golf club shaft 14 from abrasion against an upper interior surface of a receiving tube 18 of a golf bag 20. A method and use of the present invention 10 includes providing a golf club shaft protective wrap 10 including a pad means 12 for circumferential positioning about a shaft 14 of a golf club 16, and a securing means 22 extending from the pad means 12 for securing the pad means 12 in an annular configuration about the shaft 14 of the golf club 16. The method further comprises providing a golf club 16 including a shaft 14, wrapping the pad means 12 into an annular configuration about the shaft 14 of the golf club 16, engaging the securing means 22 with the pad means 12 so as to retain the golf club shaft protective wrap 10 in the annular configuration about the shaft 14 of the golf club 16, and subsequently positioning the shaft 14 of the golf club 16 into a receiving tube 18 of a golf bag 20 such that the golf club shaft protective wrap 10 resides between the shaft 14 and the receiving tube 18 of the golf bag.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A golf club shaft protective wrap comprising:

a golf bag having at least one receiving tube;

a pad means for positioning circumferentially about the shaft of a golf club and between an exterior surface of the shaft and an interior surface of a receiving tube of the golf bag for protecting the shaft from abrasion against an upper interior surface of the receiving tube, the pad means comprising a first pad strip coupled to a second pad strip and including an elongated pad member interposed between the pad strips, the pad strips being stitched to the elongated pad member, wherein the elongated pad member and the pad strips attached thereto are circumferentially extended about the shaft of a golf club so as to reside in an annular configuration thereabout and between the shaft and the receiving tube of the golf bag;

a securing means extending from the pad means for securing the pad means in the annular configuration about the shaft of a golf club, the securing means comprising a first securing strip extending from the pad means, and a second securing strip coupled to the first securing strip, the securing means extending onto a portion of the pad means and being attached to the pad means so as to retain the pad means in the annular configuration; and the first pad strip being integrally coupled to the first securing strip, the second pad strip being integrally coupled to the second securing strip, the pad strips each including a hook and loop fabric fastening material, the securing strips each including hook and loop fabric fastening material cooperable with the hook and loop fabric fastening material of the pad strips such that the securing strips being positioned into abutting contact with the pad strips to engage the hook and loop fabric fastening materials to retain the pad means in the annular configuration about the shaft of a golf club.

2. A method of protecting a golf club shaft from abrasion comprising the steps of:

providing a golf club having a shaft;

providing a golf bag having at least one receiving tube;

providing a golf club shaft protective wrap including a pad means for circumferential positioning about the shaft of the golf club, and a securing means extending from the pad means for securing the pad means in an annular configuration about the shaft of the golf club;

wrapping the pad means into an annular configuration about the shaft of the golf club;

engaging the securing means with the pad means so as to retain the golf club shaft protective wrap in the annular configuration about the shaft of the golf club;

positioning the shaft of the golf club into the receiving tube of the golf bag such that the golf club shaft protective wrap resides between at least a portion of the shaft of the golf club and the receiving tube of the golf bag.

* * * * *